US008678769B2

(12) United States Patent
Kubota et al.

(10) Patent No.: US 8,678,769 B2
(45) Date of Patent: Mar. 25, 2014

(54) COMPRESSOR IMPELLER AND METHOD OF MANUFACTURING THE SAME

(75) Inventors: Yasuhiro Kubota, Matsue (JP); Hirokazu Itoh, Higashiizumo (JP); Mikio Sasaki, Moka (JP)

(73) Assignees: Hitachi Metals Precision, Ltd., Tokyo (JP); Hitachi Metals, Ltd., Tokyo (JP)

( * ) Notice: Subject to any disclaimer, the term of this patent is extended or adjusted under 35 U.S.C. 154(b) by 1311 days.

(21) Appl. No.: 11/574,658

(22) PCT Filed: Feb. 21, 2006

(86) PCT No.: PCT/JP2006/003066

§ 371 (c)(1),
(2), (4) Date: Jul. 10, 2009

(87) PCT Pub. No.: WO2006/090702

PCT Pub. Date: Aug. 31, 2006

(65) Prior Publication Data

US 2009/0274560 A1 Nov. 5, 2009

(30) Foreign Application Priority Data

Feb. 22, 2005 (JP) ..... 2005-045157

(51) Int. Cl.
*F04D 29/02* (2006.01)
*F04D 29/30* (2006.01)

(52) U.S. Cl.
USPC ..... 416/183; 416/185; 416/238; 416/241 R; 164/45; 164/113; 164/120; 164/137; 164/339

(58) Field of Classification Search
USPC ..... 416/183, 185, 186 R, 188, 223 B, 238, 416/241 R; 164/45, 113, 120, 137, 339; 249/59; 264/318; 29/DIG. 45; 425/438, 425/441, DIG. 58
See application file for complete search history.

(56) References Cited

U.S. PATENT DOCUMENTS 4,284,124 A 8/1981 Komatsu et al.
4,934,442 A * 6/1990 Futamura et al. ..... 164/120

(Continued)

FOREIGN PATENT DOCUMENTS

GB 2402991 A 12/2004
JP 57171004 A 10/1982

(Continued)

OTHER PUBLICATIONS

Communication issued in counterpart EP 06714206.7 dated Nov. 23, 2012.

(Continued)

*Primary Examiner* — Christopher Verdier
(74) *Attorney, Agent, or Firm* — Sughrue Mion, PLLC

(57) ABSTRACT

A compressor impeller and a method of manufacturing the compressor impeller. The magnesium alloy compressor impeller as a die-cast part comprises a hub shaft part, a hub disk part having a hub surface extending from the hub shaft part in the radial direction, and a plurality of vane parts disposed on the hub surface. The impeller can be manufactured by a die-cast method in which a magnesium alloy heated to a liquidus temperature or higher is supplied into molds with cavities corresponding to the shape of the impeller for a filling time of 1 sec. or shorter, a pressure of 20 MPa or higher is applied to the magnesium alloy in the cavities, and the pressurized state is maintained for a time of 1 sec. or longer.

9 Claims, 5 Drawing Sheets

(56) References Cited

U.S. PATENT DOCUMENTS

| | | | | |
|---|---|---|---|---|
| 5,114,657 | A | 5/1992 | Miyajima | |
| 5,701,942 | A * | 12/1997 | Adachi et al. | 164/71.1 |
| 5,860,468 | A * | 1/1999 | Cook | 164/61 |
| 6,019,927 | A * | 2/2000 | Galliger | 264/221 |
| 6,328,530 | B1 | 12/2001 | Kato et al. | |
| 6,468,038 | B1 | 10/2002 | Kikuchi et al. | |
| 6,793,000 | B2 | 9/2004 | Fink | |
| 7,669,637 | B2 * | 3/2010 | Kubota et al. | 164/339 |
| 2002/0187060 | A1 | 12/2002 | Decker et al. | |
| 2004/0154703 | A1 | 8/2004 | Nakamura et al. | |
| 2004/0255917 | A1 | 12/2004 | Mokry | |

FOREIGN PATENT DOCUMENTS

| | | | |
|---|---|---|---|
| JP | 58070961 | A | 4/1983 |
| JP | 2004122146 | A | 4/1983 |
| JP | 63-171242 | A | 7/1988 |
| JP | 02-187243 | A | 7/1990 |
| JP | 05131259 | A | 5/1993 |
| JP | 09-272945 | A | 10/1997 |
| JP | 2000-343301 | A | 12/2000 |
| JP | 2002113749 | A | 4/2002 |
| JP | 2003094148 | A | 4/2003 |
| JP | 2005030382 | A | 2/2005 |
| JP | 2005-194605 | A | 7/2005 |
| WO | 2005/012700 | A1 | 2/2005 |
| WO | WO-2005/116454 | A1 * | 12/2005 ..... F04D 29/28 |

OTHER PUBLICATIONS

"Taschenbuch 2006 GieBerei-Praxis", Herausgegeben von Dr. mont. Stephan Hasse.

Wikipedia, "Magnesiumdruckguss", Sep. 2005.

Supplementary European Search Report issued in Application No. 06714206.7 dated Feb. 24, 2012.

Indian Office Action in corresponding Application No. 1727/DELNP/2007 dated Mar. 22, 2011.

* cited by examiner

COMPRESSOR IMPELLER AND METHOD OF MANUFACTURING THE SAME

TECHNICAL FIELD

The present invention relates to a compressor impeller used at an intake side of a supercharger, which makes use of exhaust gas from an internal combustion engine to feed a compressed air, and a method of manufacturing the same.

BACKGROUND ART

In a supercharger incorporated in an internal combustion engine of, for example, an automobile, ships and vessels, a turbine impeller at an exhaust side is caused to rotate with utilization of exhaust gas from an internal combustion engine, thereby rotating a coaxial compressor impeller at an intake side, or by rotating the coaxial compressor impeller, to suck and compress an outside air and to supply the compressed air to the internal combustion engine to increase an output of the internal combustion engine.

Since a turbine impeller used for the supercharger described above is exposed to high temperature exhaust gas discharged from an internal combustion engine, super alloys of Ni-base, Co-base, Fe-base, etc. proposed in, for example, JP-A-58-70961 (Patent Publication 1) have been conventionally used therefor. In recent years, titanium alloys and aluminum alloys have been also used. On the other hand, a compressor impeller is positioned in a location at which an outside air is sucked, and used in a temperature environment in the order of 100° C. to 150° C. Therefore, aluminum alloys conventionally have been used much for the compressor impeller instead of alloys having heat high resistance like as super alloys being used for the turbine impeller described above.

In recent years, various examinations have been made for further high speed rotation of a turbine impeller and a compressor impeller with a view to an improvement in combustion efficiency of an internal combustion engine. In rotating an impeller at high speed, it is desired that, in particular, a compressor impeller be high in strength (referred below to as specific strength) per unit density, that is, lightweight and high in strength. Also, it is predicted that a temperature environment at the time of high speed rotation will rise to a temperature beyond 180° C. to 200° C., and it is therefore desired that the impeller have a favorable toughness, be further high in strength, and can be maintained high in strength even when a temperature environment exceeds 200° C.

In the light of such background, a compressor impeller proposed by, for example, JP-A-20003-94148 (Patent Publication 2) is being put to practical use, which is made of a titanium alloy to be able to be made more lightweight than that made of the Ni heat resistant alloy, etc. and to be higher in strength than that made of a conventional aluminum alloy.

Generally, a compressor impeller is complex in shape such that a plurality of blade parts having an aerodynamically curved surface are arranged radially around a hub shaft part on a hub surface of a hub disk part extending radially of the hub shaft part being a rotational center axle. Also, there are also existent an impeller including a blade part composed of full blades and splitter blades and an impeller having a complex shape, in which an undercut extends radially outwardly of a hub shaft part.

A compressor impeller having such complex shape is formed by measures such as machining, by which a blade part is cut from an impeller material, deformation and straightening of a blade part after an impeller material having a shape affording casting is once formed, as proposed by JP-A-57-171004 (Patent Publication 3), or the like. Also, there is also existent a method, in which an sacrificial pattern having a blade part and a hub part of an impeller made integral is formed in a die by means of the plaster mold process, the lost wax casting process and used to fabricate a casting mold, and a molten metal is cast into the casting mold to form an impeller. In this case, for example, the Patent Document 2 and JP-A-2002-113749 (Patent Document 4) propose a die structure to release blade parts from a die, in which an sacrificial pattern is formed.

Patent Publication 1: JP-A-58-70961
Patent Publication 2: JP-A-2003-94148
Patent Publication 3: JP-A-57-171004
Patent Publication 4: JP-A-2002-113749

DISCLOSURE OF THE INVENTION

Problems to be Solved by the Invention

In order to rotate a compressor impeller at higher speed than conventional, a conventional impeller made of an aluminum alloy is not sufficient in terms of mechanical strength such as specific strength, etc. Also, since an impeller made of a titanium alloy is sufficient in strength and specific strength even in a temperature zone exceeding 200° C., it is assuredly suited to a compressor impeller. However, a titanium alloy is very expensive as compared with an aluminum alloy, which presents a factor to impede the spread.

Also, with respect to measures of manufacture of a compressor impeller, measures of machining such as cutting of an impeller material, etc. are high in manufacturing cost to be disadvantageous in terms of machining time and material yield. Also, with measures of form adjustment of a blade part of a cast compressor impeller, it is hard to obtain a favorable form accuracy, which makes it difficult to ensure a balance in rotation. While a relatively favorable form accuracy is obtained with the plaster mold process and the lost wax casting process, dissatisfaction in terms of production efficiency and manufacturing cost remains in forming an impeller through the medium of a sacrificial pattern and manufacturing a sacrificial pattern and a casting mold for casting, or the like.

An object of the invention is to solve the problems described above and to provide a compressor impeller, which is larger in specific strength than a conventional impeller made of an aluminum alloy, lower in cost than an impeller made of a titanium alloy, and can accommodate further high-speed rotation.

Measure for Solving the Problems

The present inventors have reached the invention finding that a compressor impeller made of a magnesium alloy can be manufactured by the die-casting process. Thus, according to a first aspect of the invention, there is provided a compressor impeller, which is made of a magnesium alloy and is a die-cast product, comprising a hub shaft part, a hub disk part having a hub surface extending from the hub shaft part in a radial direction, and a plurality of blade parts provided on the hub surface.

In the compressor impeller, the plurality of blade parts may consist of alternately adjacent full blades and splitter blades. Also, in the compressor impeller, an undercut extending radially outwardly from the hub shaft part may be present in respective blade spaces defined between a pair of adjacent full blades.

Also, according to a second aspect of the invention, there is provided a method of manufacturing a compressor impeller by a die-casting process, in which:

a magnesium alloy heated to a liquidus temperature or higher is supplied into dies defining a cavity corresponding to the shape of the compressor impeller for a filling time of 1 sec. or shorter, the compressor impeller comprising a hub shaft part, a hub disk part having a hub surface extending from the hub shaft part in a radial direction, and a plurality of blade parts provided on the hub surface, a pressure of not less than 20 MPa is consecutively applied to the magnesium alloy in the cavity, and the pressurized state is maintained for a time of not less than 1 sec.

According to an embodiment of the manufacturing method of the invention, in the compressor impeller, the plurality of blade parts may consist of alternately adjacent full blades and splitter blades. Also, in the compressor impeller, an undercut extending radially outwardly from the hub shaft part may be present in respective blade spaces formed between a pair of adjacent full blades.

According to a further embodiment of the manufacturing method of the invention, a pressure in the cavity is preferably reduced to 0.5 MPa or lower after the lapse of the pressurization maintaining time. According to a still further embodiment of the manufacturing method of the invention, the cavity is defined by arranging a plurality of slide dies, having a shape corresponding to a space between adjacent blades, radially relative to the hub shaft part. According to a still further embodiment of the manufacturing method of the invention, the cavity is defined by arranging a plurality of slide dies, which include a bottomed groove corresponding to a shape of a splitter blade and a configured body corresponding to a space defined by the pair of full blades adjacent to the splitter blade, radially relative to the hub shaft part.

Effect of the Invention

Since the compressor impeller according to the invention is one made of a magnesium alloy formed by the die-casting process, it is possible to obtain a compressor impeller, which is larger in specific strength than a conventional impeller made of an aluminum alloy. Also, since an impeller is made of a magnesium alloy, which is lower in cost than a titanium alloy, and has a die-casting process of high productivity, in which a molten metal is poured directly into a cavity of dies, applied thereto, it is possible to obtain an inexpensive compressor impeller. The invention can provide a compressor impeller capable of accommodating a further high-speed rotation than conventional, and a method of manufacturing the same, and becomes a very effective technique in industrial use.

BEST MODE FOR CARRYING OUT THE INVENTION

As described above, a key feature of the invention resides in that a compressor impeller made of a magnesium alloy being a die-cast product and comprising a hub shaft part, a hub disk part having a hub surface extending from the hub shaft part in a radial direction, and a plurality of blade parts provided on the hub surface is made a compressor impeller made of a magnesium alloy as die-cast.

A magnesium alloy used in the invention generally has a density in the order of 1.8 g/cm$^3$ and is small in density as compared with an aluminum alloy, which has a density in the order of 2.7 g/cm$^3$, and other practical materials. Therefore, a compressor impeller made of a magnesium alloy is made lighter than an impeller made of an aluminum alloy, so that it is possible to decrease an inertia load in rotation. Also, it is possible to expect that the specific strength of a magnesium alloy is 1.3 times or more that of an aluminum alloy even in a temperature environment of 200° C. Accordingly, the compressor impeller, according to the invention, made of a magnesium alloy can accommodate a further high-speed rotation. Further, since a magnesium alloy exists in abundance as a mineral resource, stable supply is expected and supply can be effected at a lower cost than that of an impeller made of a titanium alloy.

Also, since a magnesium alloy is markedly smaller in affinity with iron than an aluminum alloy, there is an advantage that even when, for example, a die made of an iron alloy is used a casting mold, a cast impeller can be smoothly released without seizure to the dies.

The compressor impeller according to the invention comprises a compressor impeller as formed by die-casting. An impeller as formed by die-casting can form a compact, uniform solidification structure since its surface layer and a thin-walled portion are rapidly quenched. Specifically, a fine, compact, rapidly quenched structure having an average particle size of, for example, 15 μm or less is formed on a blade part, which is thin-walled to have a small thermal capacity. Also, a hub disk part and a hub shaft part, which are massive to have a large thermal capacity, are formed on, for example, a surface layer thereof with a fine, compact, solidification structure, which has an average particle size of, for example, 15 μm or less, and formed in the vicinity of a core thereof with a solidification structure, which has an average particle size of 50 μm or less and is larger than that of a surface layer. A coagulation rate is gradually decreased toward a core of an impeller from a surface side thereof, so that a solidification structure having a larger, average particle size than that of a rapidly quenched solidification structure is formed in the vicinity of a core of a hub disk part or a hub shaft part. The reason for this is that since a die is used as a casting mold in the die-casting process, it is markedly higher in cooling power than a refractory material, etc. used in the lost wax casting process, etc. and a molten metal in contact with a die is rapidly cooled on a thin-walled blade part, and surface layers of a disk part or a hub shaft part. Also, die-casting formation has an advantage that since a molten metal is poured into a cavity of dies at high pressure, the molten metal is improved in close contact property to a die surface whereby the molten metal is increased in cooling rate.

By forming a casting structure of an impeller into the fine, compact, rapidly quenched structure described above, the impeller can be improved in surface hardness and fatigue strength to achieve an improvement in strength and toughness as an impeller. Also, by further subjecting an impeller with the solidification structure to heat treatment such as T6 treatment (JIS-H0001) or the like, effects owing to solution treatment and aging effect are added while a matrix of a compact crystal structure is maintained, so that a further increase in strength is made possible. Also, since dies are used in the die-casting process, a casting surface of an impeller becomes smaller in surface roughness than in case of using a refractory material. Thereby, an impeller surface is decreased in aerodynamic resistance to enable contributing to an improvement of the aerodynamic performance of an impeller.

Also, there are some cases, in which machining such as cutting, etc. is applied to an outer periphery of a hub shaft of an impeller, or an impeller itself is subjected to chemical conversion treatment, anodic oxidation treatment, surface treatment such as plating, coating, etc. Since a configured body of a magnesium alloy as formed by die-casting is made further fine and uniform in grain size, an improvement in machinability at room temperature and quality of film formation on a surface is achieved. Accordingly, the compressor impeller, according to the invention, as formed by die-casting, becomes an excellent compressor impeller, in which a blade part becomes high in strength, a hub disk part and a hub shaft part are high in strength as well as appropriate in toughness, and which possesses machinability at room temperature.

Subsequently, a specific example of a configuration of a compressor impeller according to the invention is cited and described with reference to the drawings. FIG. 1 is a schematic view showing a compressor impeller 1 (referred below to as impeller 1) used on an intake side of an automobile turbocharger. The impeller 1 includes a hub shaft part 2, a hub disk part 4 having a hub surface 3 extending from the hub shaft part 2 in a radial direction, and a blade part, on which a plurality of full blades 5 and splitter blades 6, respectively, are alternately protrusively provided in a radial manner. FIG. 2 is a simplified view showing the blade part of the impeller 1 and illustrating only two full blades 5 and one splitter blade 6 for the sake of clarity. Also, a hatched area in FIG. 2 corresponds to a blade space 8 surrounded by the hub surface 3 and a blade surface 7 of two adjacent full blades 5 including a single splitter blade 6. The blade surfaces 7 of the full blade 5 and the splitter blade 6 include complex, aerodynamically curved surfaces on front and back sides.

The compressor impeller according to the invention can be provided by replacing all the splitter blades 6 in the compressor impeller 1 described above by full blades 5. Also, the blades in the impeller can be made 8 to 14 in number. Also, the respective parts in the impeller can be formed to be sized such that the hub shaft part has an outside diameter of 7 to 30 mm, the hub disk part has an outside diameter of 30 to 120 mm and a wall thickness of 2 to 5 mm on an outermost peripheral portion thereof, the blades have a wall thickness of 0.2 to 2 mm in the vicinity of blade tip ends, a wall thickness of 1 to 5 mm in the vicinity of blade centers, and a wall thickness of 1.5 to 8 mm on blade bases close to the hub surface. With such impeller, while the blade part is thin-walled, the hub shaft part and the hub disk part are formed into a mass and the entire blade part is formed to amount to 10 to 30% in volume relative to the impeller. Also, a compressor impeller will do including an undercut provided radially outwardly of the hub shaft part in the blade space of the impeller.

The compressor impeller according to the invention can be manufactured by, for example, the following manufacturing method according to the invention. Specifically, a compressor impeller can be manufactured by a die-casting process, in which a magnesium alloy heated to a liquidus temperature or higher is supplied into dies having a cavity corresponding to the shape of the compressor impeller, which includes a hub shaft part, a hub disk part having a hub surface extending from the hub shaft part in a radial direction, and a plurality of blade parts provided on the hub surface, for a filling time of not more than 1 second, a pressure of 20 MPa or higher is applied to the magnesium alloy in the cavity, and the pressurized state is maintained for a time of 1 sec. or longer. An important feature of the manufacturing method according to the invention resides in that a magnesium alloy is cast into a cavity of dies under the die-cast forming condition described above.

The die-cast forming condition in the invention with the use of a magnesium alloy will be described below in detail. A magnesium alloy being poured into a cavity of dies has a molten metal temperature equal to or higher than a liquidus temperature of a magnesium alloy being used. This is because it is necessary to prevent a molten metal from solidifying before it reaches a cavity. Also, it does not matter how high a molten metal temperature is as far as a magnesium alloy component can be ensured and any inconvenience is not caused due to scattering of a molten metal, entrainment of gases, etc. at the time of casting.

Also, a molten metal of a magnesium alloy is supplied into a cavity for a filling time of 1 sec. or shorter to cast a blade part of an impeller well. In order to get an excellent, aerodynamic performance, a blade part of a compressor impeller is normally designed to have a very thin wall thickness as compared with a hub disk part, which has a hub surface. Therefore, a blade part cavity of dies defined corresponding to the blade part makes a space in the form of a very narrow, deep groove. Hereupon, a molten metal is rapidly and adequately supplied into the blade part cavity of the dies by supplying a molten metal for the filling time described above. Thereby, a casting defect such as bad running of a molten metal, entrainment of gases in the blade part cavity, etc. is prevented. It does not matter how short a filling time of a molten metal is as far as any inconvenience is not caused due to scattering of a molten metal, entrainment of gases, etc. when casting.

Subsequently, after a magnesium alloy is poured into a cavity of dies, a pressure of 20 MPa or higher is applied thereto, and the pressurized state is maintained for a time of 1 sec. or longer. Preferably, such operation is performed as rapid as possible after a molten metal is poured. Thereafter, the molten metal is solidified in the cavity to form an impeller. With the impeller, a blade part being thin-walled and small in heat capacity is first formed, and an outermost diameter portion and a hub surface of a hub disk part, which contacts directly with the dies, ends of a hub shaft part, etc. are formed. Solidification gradually progresses toward an interior of the hub disk part and a central portion thereof is finally solidified and formed. Therefore, a casting defect such as shrinkage cavity, etc. is liable to be generated around a center of the hub disk part, which makes a finally solidified portion. Hereupon, after a molten metal is poured, a pressure of 20 MPa or higher is applied thereto and the pressurized state is maintained for a time of 1 sec. or longer whereby an impeller is formed well. After the pressurized state is maintained for a time of not less than 1 sec., the pressure may be decreased but it is preferable to maintain the pressurized state until the molten metal is completely solidified and an impeller is formed surely.

Subsequently, a cavity of dies in the manufacturing method according to the invention, in which the impeller 1 shown in FIG. 1 can be manufactured, will be described taking an example with reference to the drawings. FIG. 3 shows an example of a die device. Dies include a moving die 21 capable of opening and closing in an axial direction 9 of an impeller, a stationary die 22, and slide dies 23 and slide supports 24, which are capable of moving radially relative to the axial direction 9 of an impeller. FIG. 4 is a view as viewed along an arrow and showing an essential part of the stationary die 22, only respective ones of the slide die 23 and the slide support 24 being shown for the sake of clarity. FIG. 5 is a schematic view showing the slide die 23.

The slide die 23 includes a bottomed groove portion in the form of a splitter blade and a configured body corresponding to a space defined by two full blades adjacent to a splitter blade. That is, the slide die 23 includes a hub cavity 31 corresponding to the hub surface 3 of the impeller 1, a blade cavity 32 corresponding to the full blades 5, and a bottomed groove portion 33 (shown by dotted lines) corresponding to the splitter blade 6, so as to form a configuration corresponding to the blade space 8 shown in the hatched area in FIG. 2. Also, as shown in FIG. 4, a ring-shaped support plate 25 is mounted on a bottom surface in an area, in which the slide dies 23 are radially movable relative to the axial direction 9, to support the slide dies 23. The support plate 25 is made movable in the axial direction 9 of a casting and constructed to be moved away from the slide dies 23 after the moving die 21 and the stationary die 22 are opened, and to be returned to an original position when dieclosing the dies. That is, after the moving die 21 and the stationary die 22 are opened, the slide dies 23 are supported only on the slide supports 24.

The slide dies 23, described above, the number of which corresponds to that of the blade spaces 8 of the impeller 1, are arranged annularly on the stationary die 22 as shown in FIG. 3, and the respective slide dies 23, the moving die 21, and the stationary die 22 are closed to come into close contact with one another. Thereby, a cavity having substantially the same shape as that of the impeller 1 can be formed in the dies. A molten metal of a magnesium alloy is poured into the cavity to form a casting 10.

Subsequently, the slide dies 23 are moved radially outwardly in the axial direction 9 to be released from the casting 10. Specifically, after forming a casting 10, the moving die 21 is first moved away from the stationary die 22 to be opened, and then the support plate 25 is moved away from the slide dies 23 to have the slide dies 23 supported only on the slide supports 24. As shown in FIG. 4, the slide supports 24 are taken out along grooves 26 provided on the stationary die 22 radially outwardly in the axial direction 9. At this time, the slide dies 23 are connected to rotating shafts 27 provided on the slide supports 24 whereby the slide dies 23 naturally rotate about the rotating shafts 27 to be released along surface shapes of full blades 5 and splitter blades 6 of the casting 10 with a small resistance.

After the dies release, unnecessary runner channel, sprue gate, flash, etc. may be removed from the casting 10 and the conversion treatment, anodization, surface treatment such as ceramic coating, plating, paint application, or the like may be further performed. Also, the hot isostatic pressing (HIP) treatment, sand blasting, chemical peeling, or the like may be performed. It is possible to obtain a compressor impeller of the invention with the manufacturing method described above.

In the manufacturing method described above, when the cavity of the dies is maintained in the pressurized state after casting, it is also preferable to apply local pressurization in a location in the axial direction of the hub shaft part, in which coagulation and shrinkage are liable to occur, whereby a molten metal is partially supplied to enable preventing a casting defect such as shrinkage, etc. Also, the cavity of the dies, into which a molten metal of a magnesium alloy is poured, is preferably reduced to a pressure of 20 MPa or less. Since a molten metal is poured into a cavity at high speed in die-cast formation, gases such as air, gases, etc. are liable to be entrained according to a state of running of a molten metal in the cavity, and so a pressure in the cavity is beforehand reduced. Preferably, the pressure is reduced to 0.05 MPa or lower, more preferably, to 0.005 MPa or lower. Further, in the case where a magnesium alloy susceptible to oxidation is used, for example, it is preferable to beforehand fill inert gas such as argon, etc., mixed gases of argon and hydrogen, nitrogen, etc. into the cavity to cut off oxygen, thus preventing entrainment of an oxide into a casting.

As specific examples of a preferred magnesium alloy used in the invention, for example, American Society for Testing and Materials' Standard (referred below to as ASTM) AZ91A to AZ91E are favorable in casting quality and mechanical property. Also, AS41A, AS41B, and AM50A are high in proof stress, elongation, etc. and AE42 has a high-temperature creep strength. Also, since WE43A has a higher, thermal resistance than those of all the alloys described above and WE41A and WE54A have more excellent, thermal resistance than the former, they are suited to a compressor impeller. While these magnesium alloys are a little higher in liquidus temperature than aluminum alloys, they are fairly lower in liquidus temperature than titanium alloys and so easy to regulate a molten metal temperature to a liquidus temperature or higher in case of die-cast formation. It is preferable to regulate a molten metal temperature to higher temperatures by 10 to 80° C. than a liquidus temperature to surely prevent coagulation of a molten metal midway in molten metal flow passages of a die device and a casting device.

Also, while a molten metal of a magnesium alloy may be manufactured by any method as far as being suited to a magnesium alloy as used, it suffices to perform melting with the use of, for example, a gas direct heating furnace, an electric type indirect heating furnace, a melting crucible and a melting cylinder, which are provided in a die-casting machine. Also, while a molten metal of a magnesium alloy can be treated in the atmosphere, a magnesium alloy, which contains, for example, a rare earth element, etc. to be susceptible to oxidation, is preferably treated in an atmosphere, in which inert gas such as argon, etc., $N_2$ gas, CO gas, $CO_2$ gas, etc. are used to cut off oxygen.

As described above, with the manufacturing method of the invention described as an example, it is possible to define a cavity of dies corresponding to a shape of a compressor impeller having a complex shape, in which a plurality of blade parts comprise alternately adjacent full blades and splitter blades, and it is possible to obtain a compressor impeller of the invention, which has a dense cast structure being favorable in form accuracy, is excellent in specific strength, and can be conformed to a further high speed rotation provided that the impeller can be released from dies after casting. Since any particular machining and any form regulation after casting are not applied and any sacrificial pattern copying an impeller is not formed, a marked improvement is achieved in terms of production efficiency and manufacturing cost, thus enabling providing a compressor impeller being more inexpensive than conventional ones.

Embodiment

An impeller having a shape shown in FIG. 1 was manufactured as an example of the compressor impeller of the invention by the manufacturing method of the invention described above. Specifically, ASTM Standard AZ91D having a liquidus temperature of 595° C. was selected as a magnesium alloy and melted to prepare a molten metal. The molten metal was supplied to a die-casting machine, on which a casting device shown in FIG. 3 was arranged, and poured into that cavity of dies, which was defined by the plurality of slide dies 23 shown in FIG. 5, and then the molten metal was maintained in the pressurized state to provide a casting. At this time, an interior of the cavity before pouring of a molten metal was put in the ambient air atmosphere. Also, the molten metal was regulated to be poured into the cavity at a molten metal temperature of 640° C. for a filling time of 0.02 sec. After the molten metal was filled, it was pressurized and maintained at a pressure of 40 MPa for a time of 2 sec., and then adequately cooled until the molten metal was solidified.

Subsequently, after the moving die 21 shown in FIG. 3 was separated from the stationary die 22, the slide dies 23 shown in FIG. 5 were released from a casting 10 in a procedure shown in FIGS. 7A to 7H to provide a casting 10 by die-casting. FIG. 6 is a side view showing a construction, in which the slide dies 23 and the slide supports 24 were joined, the slide dies 23 being connected to the slide support 24 with a stationary pin 29 inserted into the rotating shaft 27 through a bearing 28. Also, a guide pin 30 was provided on a bottom of the slide support 24 to serve as a guide, by which the slide support 24 was taken out along the groove 26 provided on the stationary die 22 radially outwardly in the axial direction 9. FIG. 7 is FIGS. 7A to 7H collective present a schematic view showing a specific motion procedure, in which the slide die 23 was released from a casting 10 while being moved radially outward in the axial direction 9 to be rotated, FIGS. 7A to 7H showing a state, in which the slide die 23 was being released from the casting 10. In addition, a cavity portion of the slide die 23 in FIGS. 7A to 7H is hatched as a matter of convenience for explanation of a release operation. When the slide support 24 was moved in order to release the casting 10, the slide die 23 was naturally rotated about the rotating shaft 27 while being moved along surface shapes of full blades 5 and a splitter blade 6 of the casting 10, and finally released from the casting 10 as shown in FIGS. 7G and 7H.

Unnecessary runner channel, sprue gate, flash, etc. were removed from the casting 10, and a compressor impeller of the invention was obtained having a shape including full blades and splitter blades, having an outside diameter of 13 mm for a hub shaft part, an outside diameter of 69 mm for a hub disk part, a wall thickness of 2.5 mm on an outermost diameter portion, a blade wall thickness of 0.5 mm in the vicinity of a blade tip end, 1.2 mm in the vicinity of a blade center, and 2.2 mm at a blade bases close to the hub surface, and 13% by volume for all blades relative to an impeller. As a result of carrying out tension tests by the use of gathering test pieces from within the hub disk part of the casting impeller on the basis of JIS-Z2241, thereon the specific strength was 127 MPa at 20° C. and 70 MPa at 200° C.

FIGS. 8 to 10 show examples of a cast structure of an impeller for the compressor impeller as manufactured in the manner described above. FIG. 8 shows a section of a full blade substantially perpendicular to an axial direction of a hub shaft part and presents a cast structure in the vicinity being distant 4 mm from a blade tip end and having a wall thickness of 1.15 mm. FIG. 9 shows a surface layer of a hub surface of a section of a hub disk part and presents a cast structure in the vicinity being inwardly distant 10 mm from an outermost diameter portion of the hub disk part and having a depth of 1 mm. FIG. 10 shows a cast structure in the vicinity of a central portion of an impeller, at which a plane defining an outermost diameter portion of a hub disk part intersects an axial direction of a hub shaft part. A homogeneous, dense, rapidly quenched, cast structure composed of fine crystal grains having a grain size of 5 to 10 μm was confirmed on surface layers of a blade part and a hub surface. In particular, fine crystal grains having a grain size of 5 μm or less were much formed on a thin-walled blade part. Also, a cast structure mainly composed of crystal grains having a little larger grain size of 20 μm than those on a surface layer was confirmed on a central portion of an impeller.

INDUSTRIAL APPLICABILITY

The compressor impeller of the invention is used on an intake side of a supercharger assembled into internal combustion engines of automobiles, ships and vessels, etc.

Figure 1:
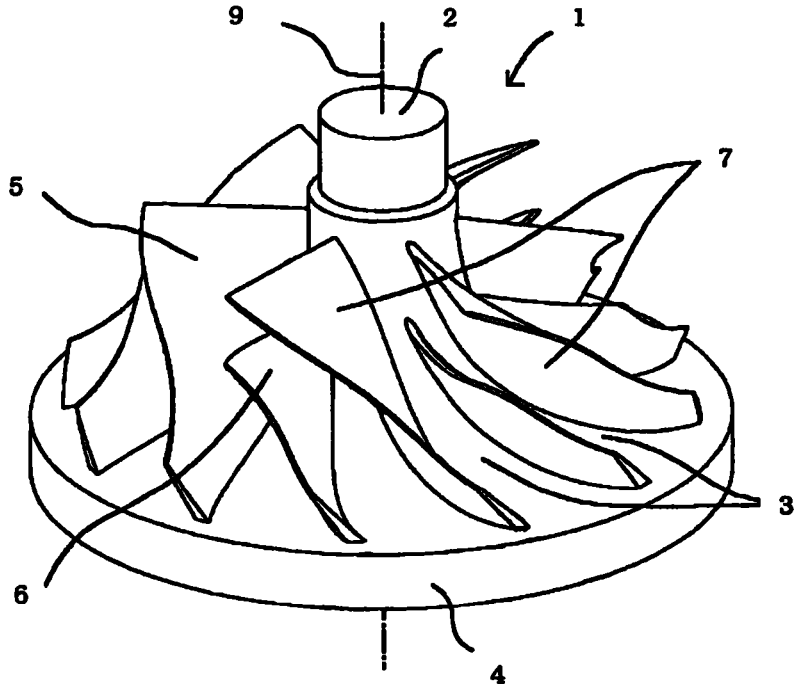
FIG. 1 is a schematic view showing an example of a compressor impeller.
Figure 2:
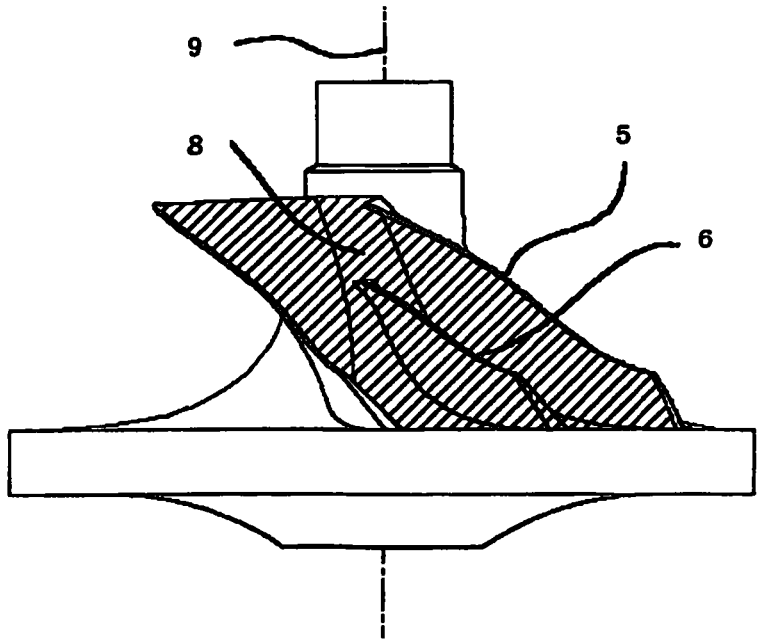
FIG. 2 is a simplified view showing an example of a blade part.
Figure 3:
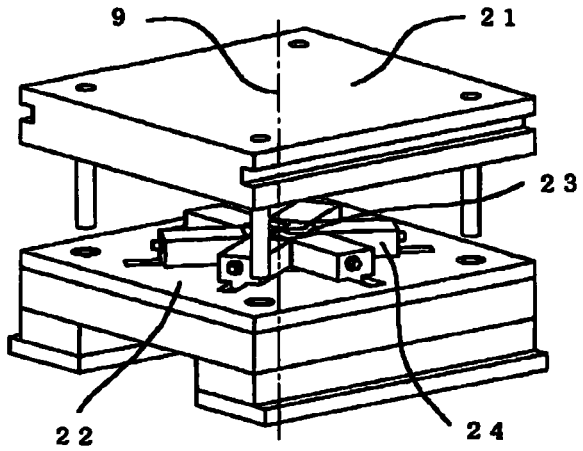
FIG. 3 is a general view showing an example of a die device.
Figure 4:
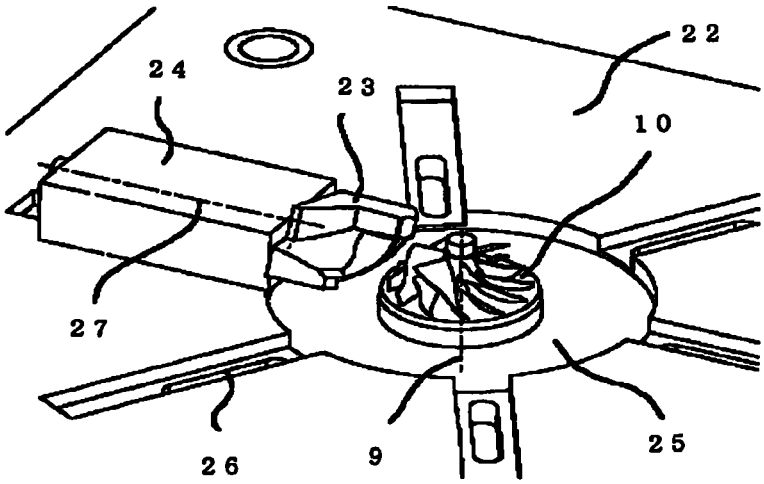
FIG. 4 is a view as viewed along an arrow and showing an essential part of an example of a stationary die.
Figure 5:
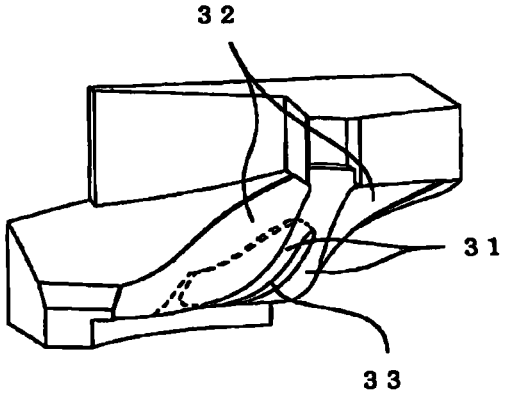
FIG. 5 is a schematic view showing an example of a slide die.
Figure 6:
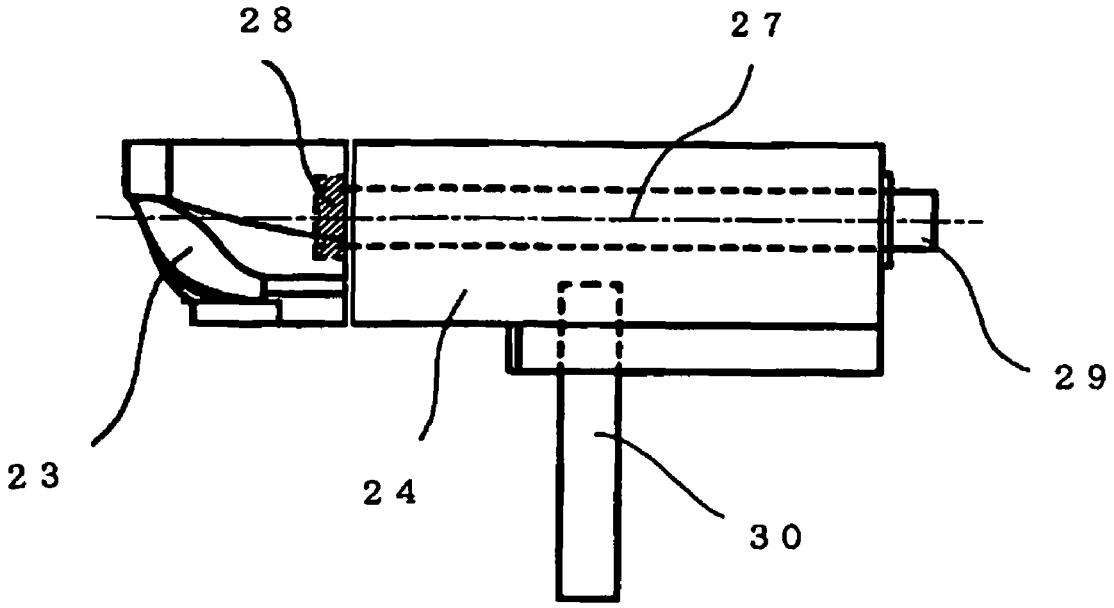
FIG. 6 is a side view showing an example of a construction, in which a slide die and a slide support are joined, FIGS. 7A to 7H collectively present a schematic view showing an example of a release operation of a slide die.
Figures 7A, 7B, 7C, 7D, 7E, 7F, 7G, 7H:
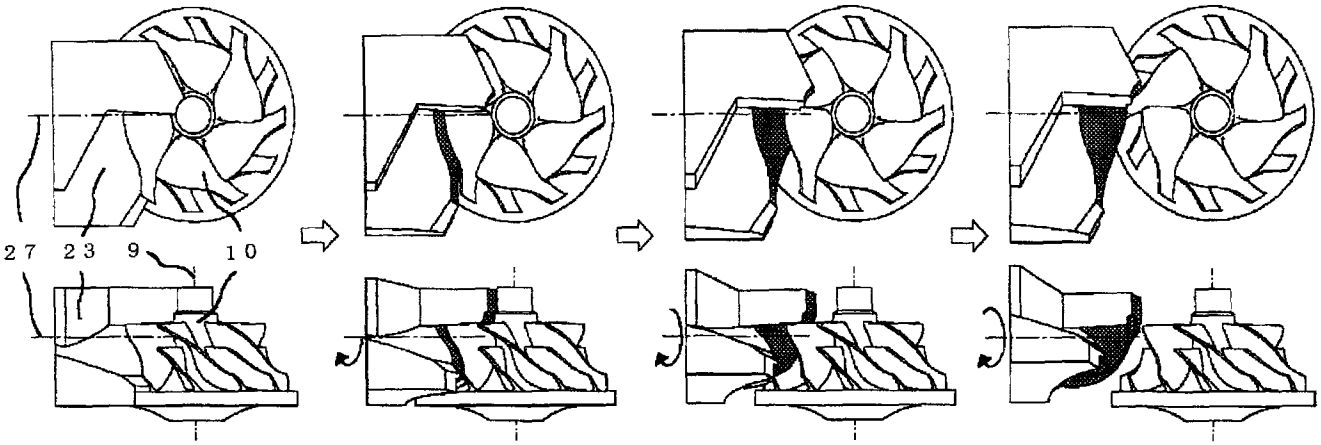
Figure 8:
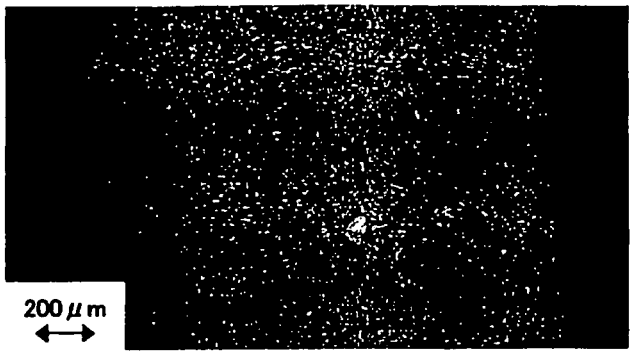
FIG. 8 is a view showing an example (photograph) of a cast structure of a blade part section of a compressor impeller according to the invention.
Figure 9:
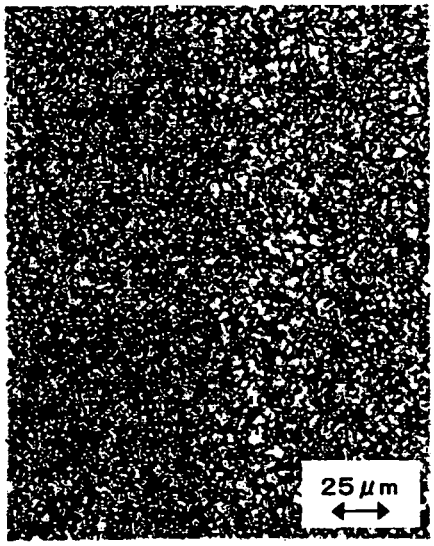
FIG. 9 is a view showing an example (photograph) of a cast structure of a surface layer of a hub surface of a disk part section of a compressor impeller according to the invention.
Figure 10:
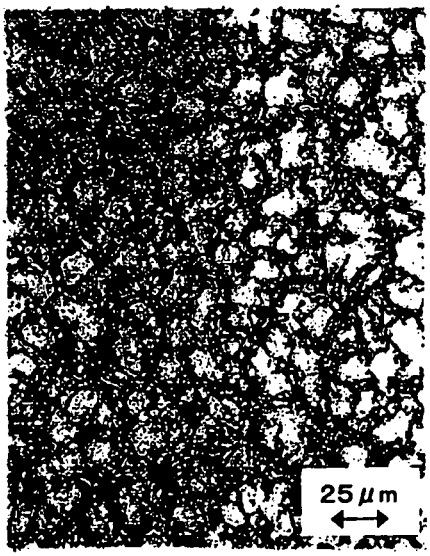
FIG. 10 is a view showing an example (photograph) of a cast structure of a central part section of a compressor impeller according to the invention.

The invention claimed is:

1. A compressor impeller comprising a hub shaft part, a hub disk part having a hub surface extending from the hub shaft part in a radial direction, and a plurality of blade parts provided on the hub surface, wherein the compressor impeller is made of a magnesium alloy and is a die-cast product, and the hub disk part comprises a surface layer having a solidification structure having an average grain size of 15 μm or less, and a core having a solidification structure having an average grain size of 50 μm or less, which is larger than that of the surface layer, in the vicinity of the core.

2. The compressor impeller according to claim 1, wherein the plurality of blade parts comprise alternately adjacent full blades and splitter blades.

3. The compressor impeller according to claim 2, wherein an undercut, extending radially outwardly from the hub shaft part, is present in respective blade spaces defined between a pair of adjacent full blades.

4. A method of manufacturing a compressor impeller by a die-casting process, in which the dies used define a cavity corresponding to the shape of the compressor impeller, and the compressor impeller comprising a hub shaft part, a hub disk part having a hub surface extending from the hub shaft part in a radial direction, and a plurality of blade parts provided on the hub surface, wherein a molten magnesium alloy heated to a higher temperature by 10 to 80° C. than a liquidus temperature of the magnesium alloy is supplied into the cavity for a filling time of 1 sec. or shorter, the cavity being previously pressure-reduced to 0.005 MPa or lower thereby causing the cavity to have an atmosphere from which oxygen is excluded, a pressure of not less than 20 MPa is consecutively applied to the molten magnesium alloy in the cavity, and the pressurized state is maintained for a time of not less than 1 sec, and wherein the hub disk part comprises a surface layer having a solidification structure having an average grain size of 15 μm or less, and a core having a solidification structure having an average grain size of 50 μm or less, which is larger than that of the surface layer, in the vicinity of the core.

5. The method according to claim 4, wherein a pressure in the cavity is reduced to 0.5 MPa or lower after the lapse of the pressurization maintaining time.

6. The method according to claim 4, wherein the plurality of blade parts comprise alternately adjacent full blades and splitter blades.

7. The method according to claim 6, wherein an undercut extending radially outwardly from the hub shaft part is present in each blade space defined between a pair of adjacent full blades.

8. The method according to claim 6, wherein the cavity is defined by arranging a plurality of slide dies radially relative to the hub shaft part, each of the slide dies having a bottomed groove corresponding to a shape of a splitter blade and a configured body corresponding to a space defined by the pair of full blades adjacent to the splitter blade.

9. The method according to claim 4, wherein the cavity is defined by arranging a plurality of slide dies, having a shape corresponding to a space between adjacent blades, radially relative to the hub shaft part.

* * * * *